United States Patent [19]

Anderson

[11] 4,059,252

[45] Nov. 22, 1977

[54] SLAG TAP

[75] Inventor: John Erling Anderson, Katonah, N.Y.

[73] Assignee: Union Carbide Corporation, New York, N.Y.

[21] Appl. No.: 690,186

[22] Filed: May 26, 1976

[51] Int. Cl.[2] ..... C21C 1/00

[52] U.S. Cl. ..... 266/236

[58] Field of Search ..... 266/236, 195, 196; 75/24, 30, 63, 89, 73–75

[56] References Cited

U.S. PATENT DOCUMENTS

| | | | |
|---|---|---|---|
| 287,646 | 10/1883 | Durfee et al. | 266/195 |
| 810,364 | 1/1906 | Allen | 266/166 |
| 902,047 | 10/1908 | Baggaley et al. | 266/161 |
| 1,126,028 | 1/1915 | Kekich | 266/196 |
| 1,149,203 | 8/1915 | Marshall | 266/195 |
| 2,284,601 | 5/1942 | Shellenberger | 122/235 |
| 2,476,889 | 7/1949 | Mohr et al. | 266/191 |
| 2,790,019 | 4/1957 | Stalego | 13/33 |
| 2,918,754 | 12/1959 | Plumer | 266/236 |
| 3,316,079 | 4/1967 | Grady | 266/195 |

*Primary Examiner*—Gerald A. Dost

*Attorney, Agent, or Firm*—Lawrence G. Kastriner; Warrick E. Lee, Jr.

[57] ABSTRACT

A device for tapping molten slag of variable composition comprising:

a. a metal duct provided with cooling means and having an inlet port at one end and a discharge port at the other, the lower portion of the face of the discharge port being sealed against the leakage of slag by being abutted against b. a highly heat-conductive, water-cooled metal weir having a surface inclined up and away from the face of said discharge port and terminating in an edge which extends across the face of said discharge port and constitutes the forward most portion of the device. The weir is preferably made of copper and the metal duct lined with a refractory material behind the weir.

5 Claims, 4 Drawing Figures

SLAG TAP

BACKGROUND

The present invention relates to an improved slag tap, i.e., a device for tapping molten fluid from the hearth of a furnance. The tap is particularly useful in operations where the refractory lining, especially at the end of the duct from which the molten fluid is discharged is exposed to corrosive conditions, and hence prone to early failure.

The flow of molten slag discharged from slagging waste disposal furnaces produces particularly harsh conditions on refractory linings exposed to it because of the variable chemical and physical properties of such slag. While for purposes of convenience the molten residue is referred to as slag, it is to be understood as including also molten metal, glass and any non-combustible inorganic residue. Devices employing refractory lined metal conduits for tapping molten fluids normally have a short service life due to the rapid deterioration of the refractory lining caused by the harsh conditions to which they are exposed.

Examples of solid waste disposal systems which provide a particularly harsh environment for refractory linings are disclosed in U.S. Pat. Nos. 3,729,298, 3,801,082 and 3,806,335, all of which relate to processes and/or apparatus for simultaneously disposing of refuse and producing useful gases and molten slag residues. In the above-mentioned waste disposal processes, refuse is fed into the top portion of a vertical shaft furnace while oxygen is fed into the base of the vertical shaft furnace. The furnace has a combustion and melting zone or hearth at the base from which molten slag is continuously tapped, using a suitable tapping device, and then quenched in a water bath.

The slag tap is subject to severe deterioration because of the wide variation in the chemical composition and temperature of the molten stream being tapped. It is common to have to shut down the furnace at frequent intervals to rebuild the tap. There are no known refractories that are not subject to rapid wear by the continuous tapping of slag of varying composition and temperature. The discharge lip is most vulnerable to attack and it is not possible with conventional tapping devices to maintain the point of discharge fixed in space.

In processes which involve continuous tapping, the discharge end of the slag tap from which the melt falls into a receiver, such as a quench tank, must remain essentially fixed in space. If it does not remain fixed, the hot slag will not fall where intended.

OBJECTS

It is consequently an object of this invention to provide an improved device for tapping molten slag from a furnace which is better able to withstand deterioration and wear caused by the flow of hot slag of varying composition through it.

It is another object of this invention to provide an improved device for tapping molten slag from a furnance which resists wear at its discharge end.

SUMMARY

The above and other objects which will be apparent to those skilled in the art are achieved by the present invention which comprises:

a device for tapping molten slag of variable composition comprising:

a. a metal duct provided with cooling means, said duct having an inlet port at one end and a discharge port at the other end, the lower portion of the face of the discharge port being sealed against the leakage of molten slag by being abutted against b. a highly heat-conductive, water-cooled metal weir, said weir having a surface sloped up and away from the face of said discharge port and terminating in an edge which extends across the face of said discharge port, said edge constituting the forward most portion of said device.

In a preferred embodiment of the above described device, the metal duct is lined with refractory material behind the weir, and the weir is made of copper. The provision of a drip point is also a preferred feature of the present invention.

DRAWINGS

DETAILED DESCRIPTION

Figure 1:
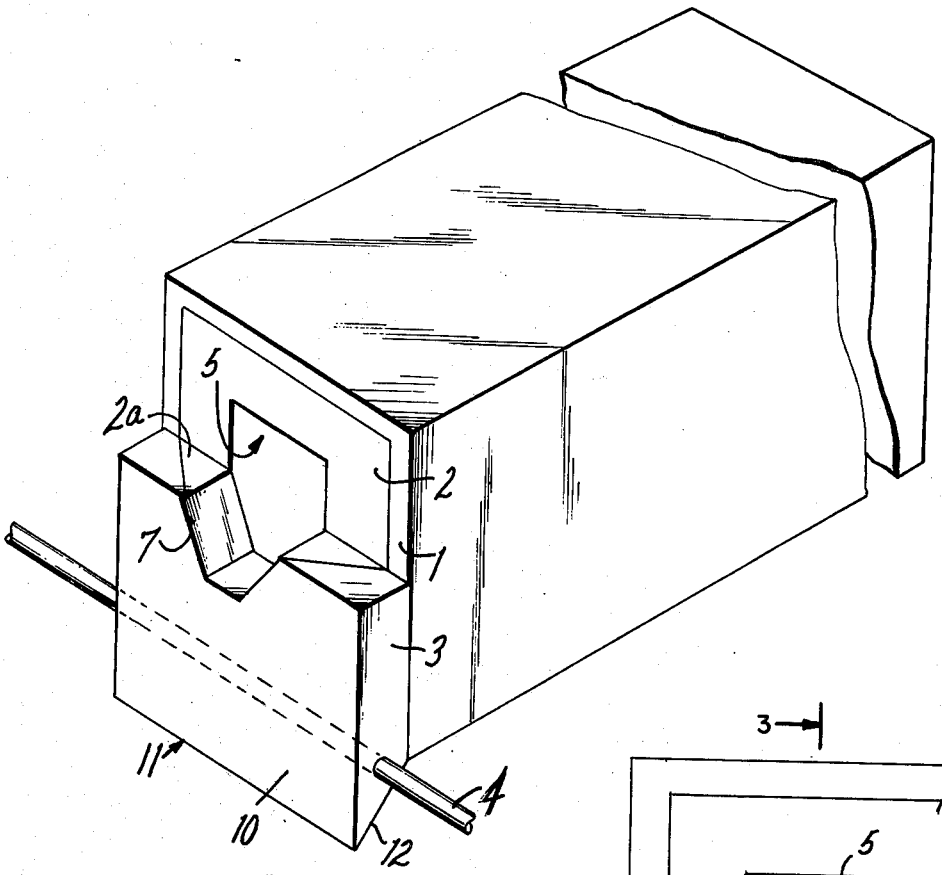
FIG. 1 is a perspective view of the front end of a preferred embodiment of a slag tap made in accordance with the invention.

The preferred embodiment of this invention comprises a refractory-lined metal duct which serves as a conduit for the flow of molten slag from a taphole, to which the inlet end is attached by conventional means, to a pour point. The latter is a fixed point or edge in space from which the molten slag flows out of the tap. It is important that the pour point remain fixed in order that molten slag continue to pour in a predetermined path to prevent accidental spillage, damage to equipment or injury to persons. In order to prevent wearing away of the refractory lining at the discharge end of the duct or of the metal duct itself, the device of this invention is provided with a water cooled copper weir of unique configuration which minimizes both heat losses from the molten fluid as well as wear at the discharge end of the duct. When covered with refractory material, the unique configuration of the weir disclosed hereafter in greater detail, permits only a thin edge of the cooled metal weir to come in contact with the hot flowing slag up to the time it reaches the pour point.

FIGS. 1–4 illustrate a slag tap made in accordance with this invention. It has a metal duct 1 of channel-shaped configuration whose vertical cross-section is rectangular. It will be apparent, however, that circular, as well as other cross-sectional ducts may be employed. Duct 1 is water - cooled by conventional means (not shown), and lined with a suitable high temperature refractory lining 2. Although the use of a refractory lining is preferred, it is not essential, since a bare metal tap will as a result of it being cooled, freeze a portion of the molten slag thereon to form a skull of hard slag. This skull will act as a refractory which will build up in thickness until it becomes a sufficient barrier to further heat transfer. At this point it will begin to wear away, but this will make the skull thinner, increasing heat transfer as well as thickness of the skull. After a time a steady-state skull thickness will be maintained. The same phenomena takes place even when a refractory lining is employed, with the skull built over the refractory layer.

Weir 3 is fixedly attached to the lower portion of the face of the discharge port 5. In order to prevent leakage, the surfaces 6 and 6a abut tightly against the mating surfaces of the front end faces of the metal duct 1 and refractory lining 2. Weir 3 has a surface 6a which slopes up and away from the face of the discharge port, terminating in an edge 7 which extends across the face of the discharge port 5. In the embodiment shown in the drawings, edge 7 has the shape of a flat bottomed V shaped through, however, the edge 7 may, for example, be semi-circular, arc-shaped, V or U shaped also. In every case though, edge 7 must be made such that it constitutes the forward most portion of the weir and therefore also of the slag tap. Weir 3 which is cooled by water pipe 4, may be covered by refractory 2a in such manner that only the edge 7 of the cooled metal weir comes in contact with molten slag. This minimizes heat loss by the slag and prevents unwanted buildup of frozen slag on the tip of the tap. Such buildup will, of course, dislocate the pour point. Since the discharge end of the tap is made of the cooled metal weir, it prevents wearing away of the refractory lining, since as the refractory is worn down, the increased heat transfer will cause a thicker skull 8 to be built up, over which the molten slag 9 flows.

Figure 2:
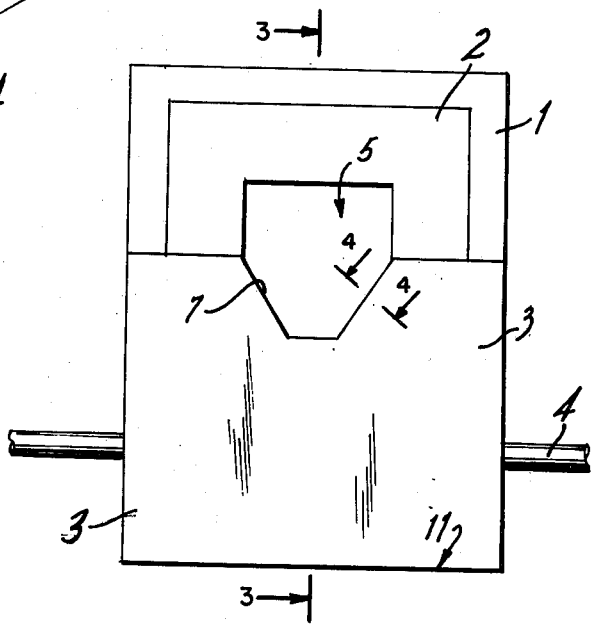
FIG. 2 is a front elevation of FIG. 1.
Figure 3:
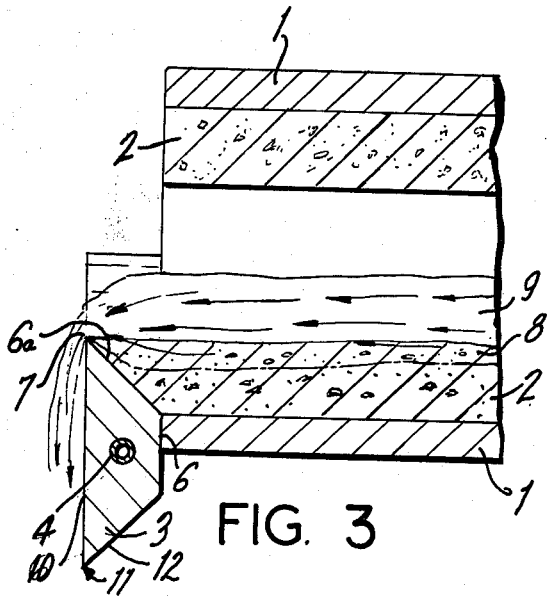
FIG. 3 is a sectional view taken along lines 3—3 of FIG. 2.
Figure 4:
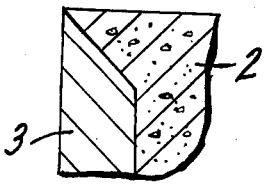
FIG. 4 is a sectional view along lines 4—4 of FIG. 2.

FIG. 4 is a view taken along lines 4—4 in FIG. 2 and discloses the relationship between the abutting surfaces of weir 3 and refractory lining 2. The lower portion of the front face 10 of weir 3 terminates in an edge 11 which, by virtue of having the rear surface of the weir 12 taper backwards and upwards from the horizontal plane, constitutes a drip point. Any slag pouring over the pour point or edge 7 which fails to clear the front face 10 of the weir will drip off the drip point or edge 11 rather than adhering to it, because the rear surface 12 tapers up and back, thereby minimizing the area of contact for slag adhesion and thus avoiding the possibility of slag buildup on the bottom of the weir.

While the device of this invention may be advantageously used for tapping molten fluid from any type of furnance wherein the tap is subject to deterioration by the molten fluid, it has been found to be particularly useful for tapping the molten metal and slag from the refuse disposal process and for use in conjunction with the apparatus described in the earlier mentioned U.S. Pat. Nos. 3,729,298, 3,801,082 and 3,806,335. Use of the tapping device of this invention in the aforementioned apparatus and processes results in a significant improvement in reducing tapping problems encountered with prior art devices, such improvement in melt handling in turn reduces the number of undesirable furnance shutdowns.

What is claimed is:

1. A device for tapping molten slag comprising:

a. a refractory lined metal duct provided with cooling means, said duct having an inlet port at one end, and a discharge port at the other end, the lower portion of the face of the discharge port being sealed against the leakage of molten slag by being abutted against b. a highly heat-conductive, water-cooled metal weir, said weir having a surface sloped up and away from the face of said discharge port and terminating in an edge which extends across the face of said discharge port, said surface being covered with refractory material such that only said edge is able to come in contact with molten slag, said edge constituting the forward most portion of said device.

2. A device as in claim 1 wherein the lower portion of the weir terminates in an edge by having the rear surface of the weir taper backwards and upwards from the horizontal plane, said edge consitituting a drip point for the molten slag.

3. A device as in claim 1 wherein the weir is made of copper.

4. A device as in claim 1 wherein the weir is made of copper, and the lower portion of the weir terminates in an edge by having the rear surface of the weir taper backwards and upwards from the horizontal plane, said edge consituting a drip point for the molten slag.

5. A device for tapping molten slag of variable composition comprising:

a. a metal duct provided with cooling means, said duct having an inlet port at one end and a discharge port at the other end, the lower portion of the face of the discharge port being sealed against the leakage of molten slag by being abutted against b. a highly heat-conductive, water-cooled metal weir, said weir having a surface sloped up and away from the face of said discharge port and terminating in an edge which extends across the face of said discharge port, said edge constituting the forward most portion of said device, wherein the lower portion of the weir terminates in an edge by having the rear surface of the weir taper backwards and upwards from the horizontal plane, said edge constituting a drip point for the molten slag.

* * * * *